US006431822B1

(12) United States Patent
Schwing

(10) Patent No.: US 6,431,822 B1
(45) Date of Patent: Aug. 13, 2002

(54) FAN SUPPORT ASSEMBLY

(75) Inventor: Kenneth A. Schwing, Brookfield, WI (US)

(73) Assignee: Tradewinds, Inc., Brookfield, WI (US)

( * ) Notice: Subject to any disclaimer, the term of this patent is extended or adjusted under 35 U.S.C. 154(b) by 0 days.

(21) Appl. No.: 09/618,905

(22) Filed: Jul. 18, 2000

Related U.S. Application Data

(60) Provisional application No. 60/148,788, filed on Aug. 13, 1999.

(51) Int. Cl.[7] ..... F04D 29/00

(52) U.S. Cl. ..... 415/5; 416/210 R; 416/244 R

(58) Field of Search ..... 416/5, 244 R, 416/210 R; 248/678, 679, 910, 519, 538

(56) References Cited

U.S. PATENT DOCUMENTS

| | | | | | |
|---|---|---|---|---|---|
| 5,232,347 | A | * | 8/1993 | VonBergen | 416/244 R |
| 5,273,402 | A | * | 12/1993 | Maury | 416/246 |
| 5,350,337 | A | | 9/1994 | Kondo et al. | |
| 5,403,162 | A | * | 4/1995 | Chen | 416/246 |
| 5,417,090 | A | * | 5/1995 | Baumann | 66/168 |
| 5,511,943 | A | * | 4/1996 | Chang | 416/5 |
| 5,558,501 | A | | 9/1996 | Wang et al. | |
| 5,562,421 | A | | 10/1996 | Huang | |
| 5,658,129 | A | * | 8/1997 | Pearce | 416/5 |
| 5,713,554 | A | * | 2/1998 | Lai | 248/522 |
| 5,956,861 | A | * | 9/1999 | Barnes | 34/90 |
| 6,017,188 | A | | 1/2000 | Benton | |
| 6,027,309 | A | * | 2/2000 | Rawls et al. | 416/5 |

OTHER PUBLICATIONS international search report dated Dec. 26, 2000 for PCT/US00/22165 counterpart application of the above–identified application.

Hunter Catalog, 40 pages, 1999, US.

Hunter Catalog, Outdoor Fans, pp. 40, 41.

* cited by examiner

*Primary Examiner*—Edward K. Look
*Assistant Examiner*—Ninh Nguyen
(74) *Attorney, Agent, or Firm*—Welsh & Katz, Ltd.

(57) ABSTRACT

A fan assembly includes a column arranged substantially vertically, and a base, the column is connected to the base to be supported and restrained in its vertical orientation. An arm has a base end connected to the column and extends from the base end horizontally to a distal end. A fan adapter plate is connected to the distal end and has a fastener hole pattern compatible with commercially available overhead fans. A weather shield can be carried by the arm and is adapted to protect a motor of the overhead fan. Alternate embodiments include a permanently attached column/base embodiment, a portable, self standing column/base embodiment, a clamp base embodiment for clamping the base to a deck, weighted base embodiments, and a horizontal wall-mounted fixture. A method of abating mosquitoes includes the use of the overhead fan in an outdoor environment.

40 Claims, 9 Drawing Sheets

FAN SUPPORT ASSEMBLY

This application claims the benefit of provisional application Ser. No. 60/148,788, filed Aug. 13, 1999 and entitled "Hanger for Ceiling Fan Or The Like".

1. Technical Field of the Invention

The present invention relates to fan support assemblies which support fans which ventilate areas. The invention particularly relates to fans which have their rotary axes oriented vertically, and are to be located above an area to be ventilated.

2. Background of the Invention

Fans which have their rotary axes in a vertical orientation, and which are located above an indoor living area, are known. Such fans are commonly referred to as "ceiling fans". When used indoors, ceiling fans are effective to circulate air which has become stratified within an enclosed room to deliver air to an elevation which is sensed by the person occupying the room. Such ceiling fans are typically useful in rooms having high ceilings.

Indoor ceiling fans provide exemplary comfort by circulating air within a room. However, ceiling fans are necessarily permanently mounted to the ceiling, including need for behind-the-ceiling electrical connections. Not all pre-existing indoor rooms are equipped with a centrally located ceiling electrical outlet to which an overhead ceiling fan can be connected. The installation of an overhead ceiling fan in a room without a pre-existing centrally located ceiling electrical outlet would be a relatively expensive and complicated installation. The present inventor has recognized that it would be advantageous to provide a mechanism for supporting an overhead fan which did not require pre-existing ceiling electrical and structural attachment elements.

Fans have also been used outdoors. Fans used outdoors are typically rotary fans having their rotary axes arranged in a horizontal orientation. In this way, the fans blow air directly at a person, creating a cooling air breeze. Such fans can be table supported or can be mounted on a stand to be held at a desired height for blowing air onto the person.

In an outdoor environment, mosquitos and other flying insects can be a nuisance to people, particularly where people are sitting for a prolonged period of time or within an area where food is being prepared or served. Attempts have been made to reduce the problem of mosquitos and other flying insects in outdoor areas which include: insecticide sprays, insect repellant lotions and sprays applied to a person's skin, insect repellant candles and torches, and electrical insect killers. The present inventor has recognized the need to more effectively reduce the number of mosquitos and other flying insects within an outdoor area.

SUMMARY OF THE INVENTION

The present invention provides support and mounting arrangements for overhead fans having vertical rotation axes.

According to a first aspect of the present invention, support and mounting assemblies are provided for overhead fans which do not require a permanent ceiling installation and which can effectively make the overhead fan portable. The fan can be electrically connected via a conventional electrical cord and plug, and can be plugged into a conventional wall outlet.

According to a second aspect of the present invention, an overhead, vertical axis rotary fan is provided for use outdoors. The fan conditions the air of the outside occupied area for comfort, and helps to reduce the number of flying insects, such as mosquitos, within the occupied area.

According to a additional aspects of the present invention, a plurality of different support arrangements or structures are provided, each holding an overhead fan above an occupied area. Each support structure can include a cantilever beam or arm which holds the fan above the area. The support structure can be bolted to an existing vertical wall adjacent the occupied area or can be supported on a column. The fan can be supported from a column that is supported vertically, and restrained horizontally, by a concrete foundation or can be supported by a column which is fastened to an external structure, such as the wall or floor of a building, a deck, a foundation or footing, slab, or a patio. The fan can be supported from a column that is supported vertically, and restrained horizontally, by a base that is held flat by its own weight, or by being fastened to an external structure. The base can be a flat plate, or a case that can be filled with water, sand or concrete.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
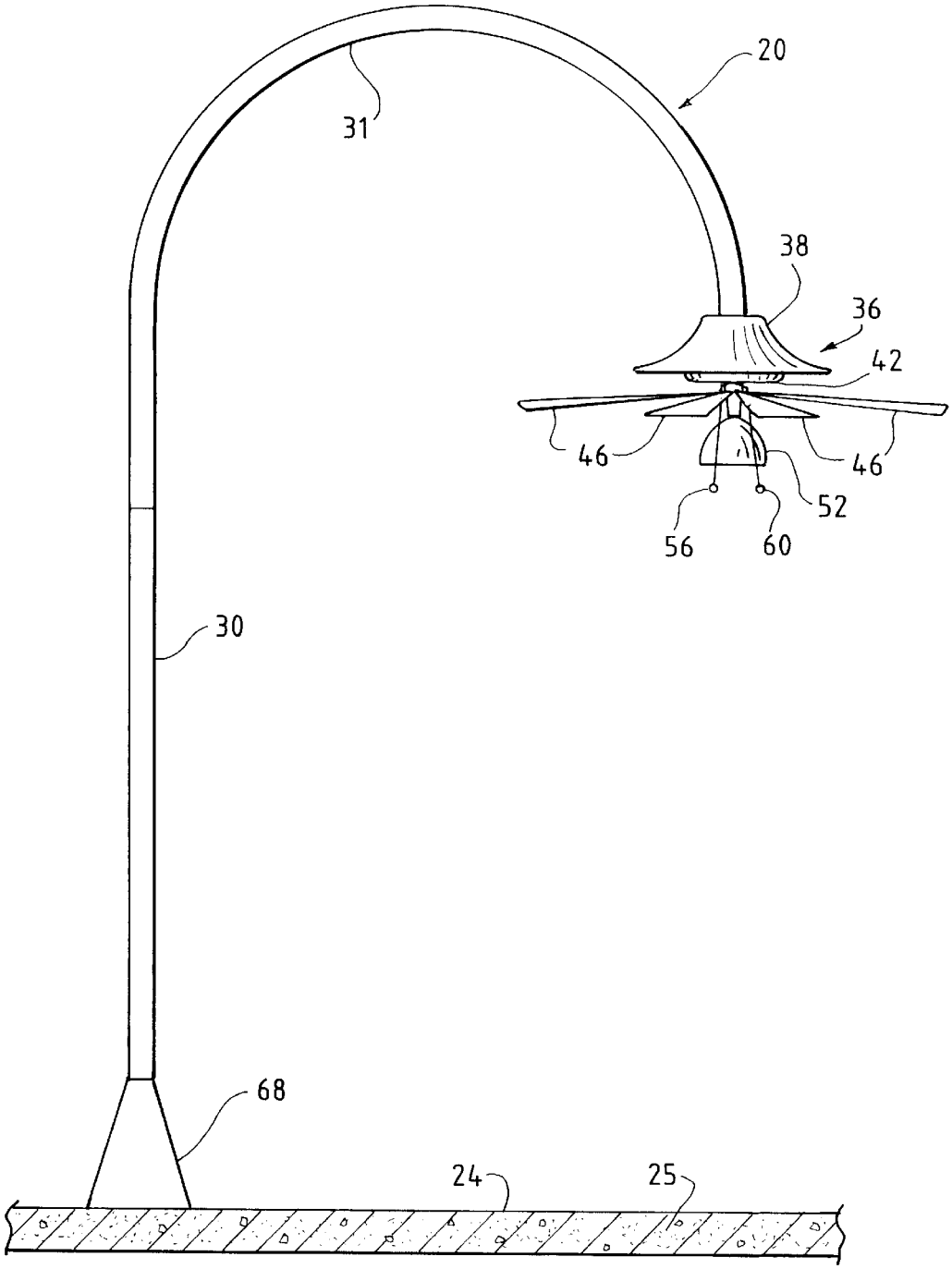
FIG. 1 is an elevational view of a first embodiment fan assembly of the present invention.

While this invention is susceptible of embodiment in many different forms, there are shown in the drawings and will be described herein in detail specific embodiments thereof with the understanding that the present disclosure is to be considered as an exemplification of the principles of the invention and is not intended to limit the invention to the specific embodiments illustrated.

FIG. 1 illustrates a first embodiment fan assembly 20 of the present invention. The fan assembly 20 is mounted on an support surface 24 in an outside area. The support surface 24 can be provided by a concrete slab 25, for example. The fan assembly 20 includes a support column or post 30 and a laterally extending arch-shaped arm 31. The arm 31 is connected at a base end thereof to the column 30 to support the arm vertically, in cantilever fashion. A fan subassembly 36 is mounted to a distal end of the arm 31. The subassembly 36 includes a weather shield 38, a fan motor 42, a fan blade or blades 46, and a light 52. The fan motor 42 is actuated by a first pull string 56 and the light 52 is actuated by a second pull string 60. Alternatively or additionally, the fan motor 42 and the light 52 can be actuated by a wall switch located near the fan assembly or inside an adjacent dwelling or building.

Figure 2:
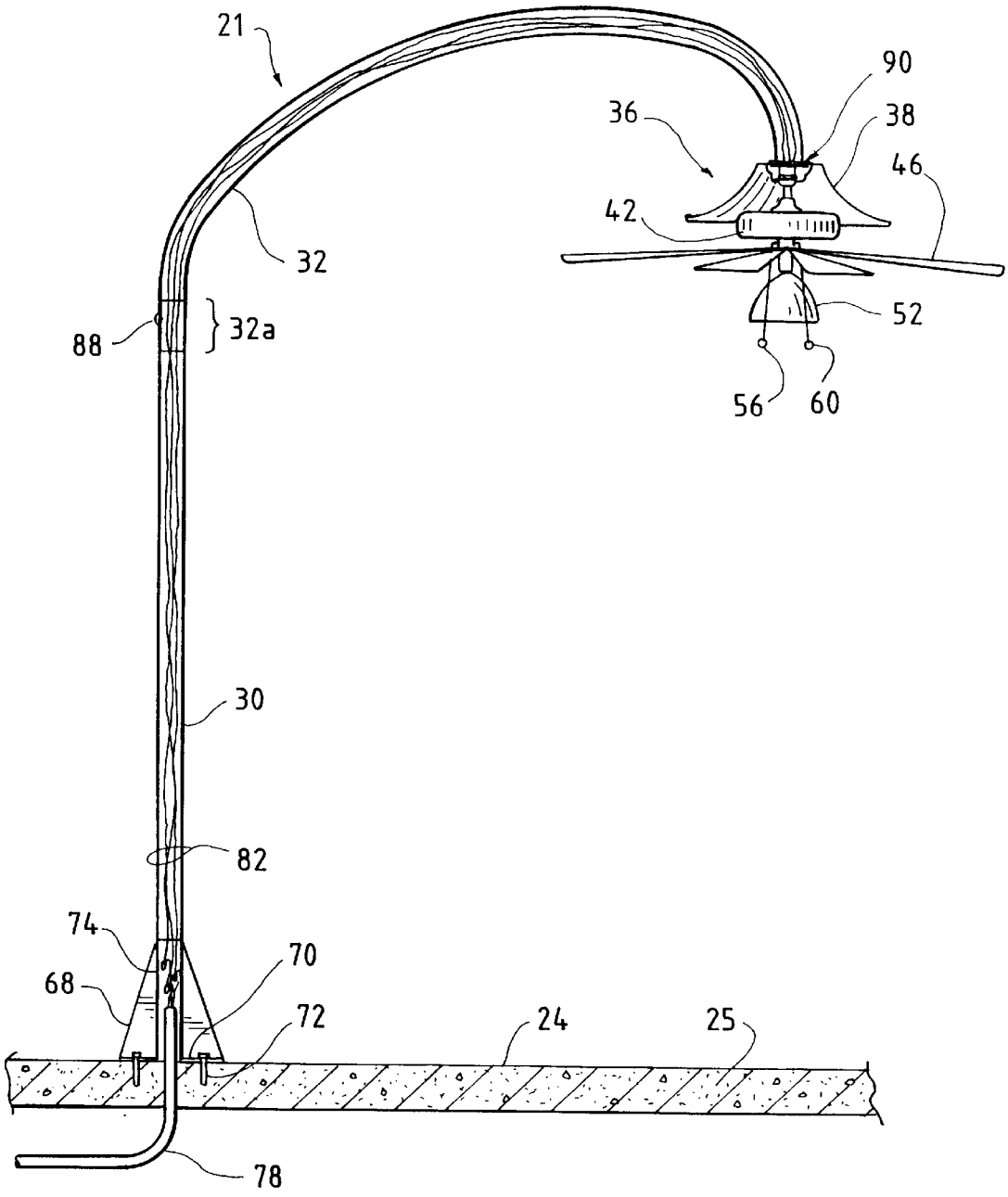
FIG. 2 is a sectional view of a substantially similar fan assembly as shown in FIG. 1.

FIG. 2 illustrates a substantially similar fan assembly 21 in more detail. This embodiment is substantially identical to the embodiment shown in FIG. 1, except a differently shaped arm 32 is used. In this embodiment, the arm 32 has an asymmetrical, flattened arch shape. Beneath a base cover 68, a base plate 70 is fastened to the slab 25 by use of anchor bolts 72. The post 30 extends through the base cover 68 and is welded to the base plate 70. A rain tight service cover 74 is located at a position slightly elevated from the base plate 70. An incoming electrical feed line or conductor carrying conduit 78 delivers wires 82 into the post 30. Splice connections are made behind the service cover 74.

The post 30 and the arm 32 are preferably hollow. The arm 32 is connected to the post 30 by being telescopically received therein approximately six inches. In this regard, the arm 32 includes a reduced diameter, swaged end region 32a which tightly fits within an open end of the post 30. A retaining screw 88 penetrates through both the post 30 and the arm 32 to fixedly hold the two pieces in their telescopic relationship. At a distal end of the arm 32 the fan subassembly 36 is connected to the arm 32 by a connection assembly 90 described in more detail in FIGS. 3–7. Wiring for transmitting electrical power from the incoming feed line 78 to the light 52 and to the fan motor 42 is accomplished by the wires 82 which are carried within the post 30 and the arm 32 to the fan motor 42 and to the light 52.

Figure 3:
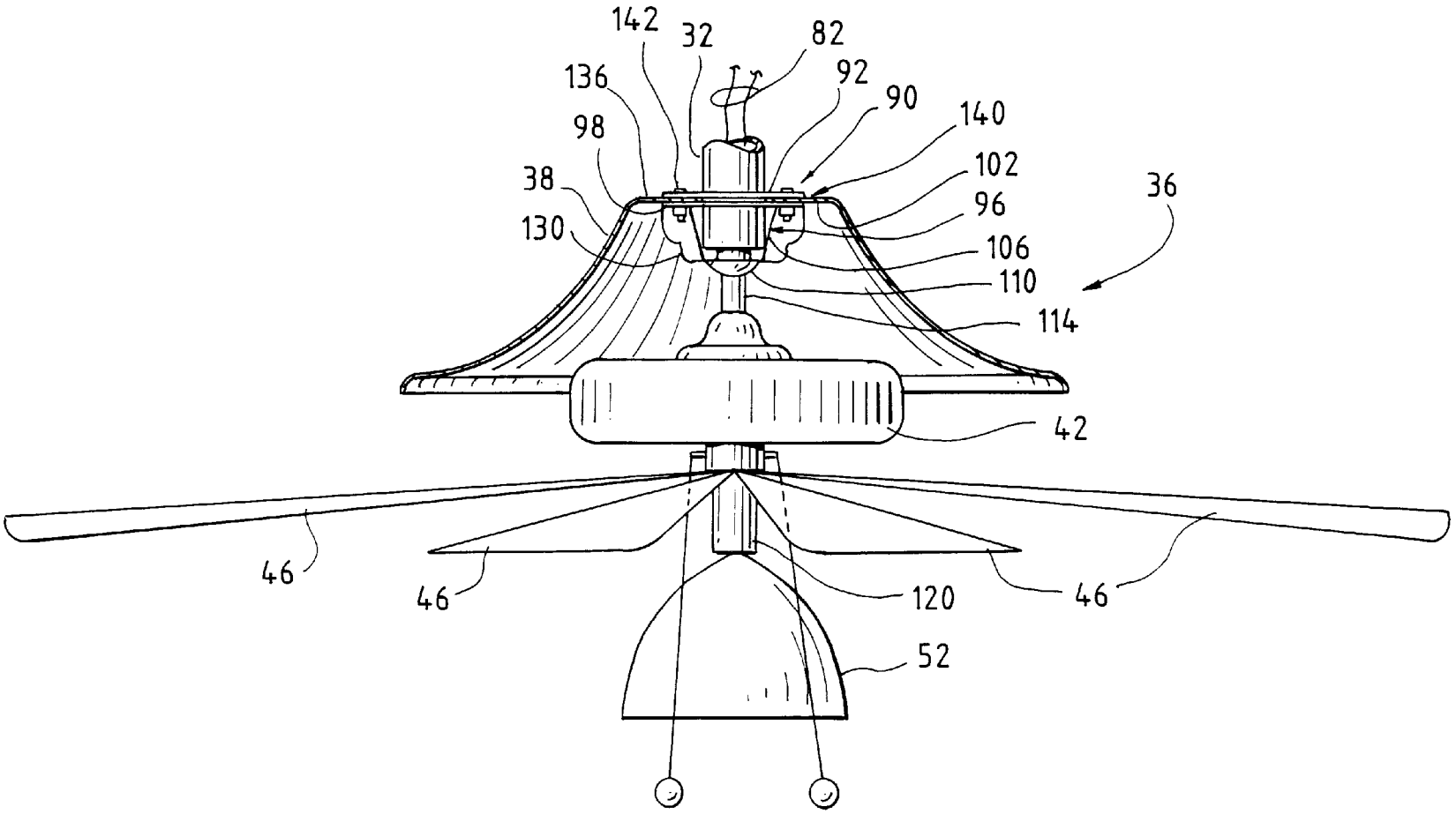
FIG. 3 is an enlarged sectional view of a portion of the fan assembly shown in FIG. 2.

FIG. 3 illustrates the connection of the fan subassembly 36 in more detail. The connection assembly 90 includes an adapter plate 92 which is welded to the arm 32. A contoured mounting bracket 96 is arranged within the weather shield 38. The contoured mounting bracket 96 has a flange 98 pressed against a bottom surface 102 of the weather shield 38. The bracket 96 includes a dished area 106 extending downwardly from the flange 98. A fan retaining-and-pivot ball joint 110 is held within a concave region 111 of the bracket 96 and permits some movement therebetween. A support conduit 114 is connected to the ball joint 110 and the fan motor 42. The fan motor 42 includes a vertical output shaft (not shown) connected to the blades 46. The light 52 is connected to the fan motor 42 through a stationary support conduit 120. Thus, the fan motor 42 and the fan blades 46 and the light 52 are all supported through the support conduit 114 and the ball joint 110. Electric wires 82 which pass through the arm 32 are connected by wire nuts to connection wires (not shown) which pass through the ball joint 110 and the support conduit 114, and are connected to and pass through the fan motor 42, to the light 52, to make the necessary electrical power connections. A decorative cover 130 surrounds the mounting bracket 96 and is fastened to the connection assembly 90. A gasket 140 for weather sealing between the shield 38 and the arm 32 is fit between the adapter plate 92 and a top surface 136 of the shield 138. Fasteners 142 clamp together the adapter plate 92, the gasket 140, the top surface 136 of the shield 138, and the flange 98 of the bracket.

All of the elements (42, 46, 52, 96,110, 114) below the weather shield 38 together constitute a typical, commercially available overhead ceiling fan.

Figure 4:
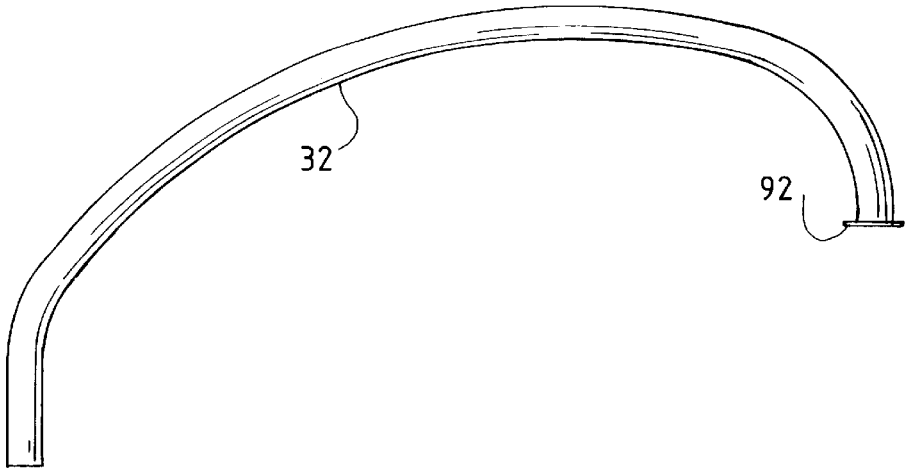
FIG. 4 is a fragmentary elevational view of a portion of the fan assembly of FIG. 1.

FIG. 4 illustrates the connection of the adapter plate 92 to the arm 32. The adapter plate 92 is welded to the arm 32, either partially or completely around the as end of the arm 32. The arm 32 is illustrated having the asymmetrical, flattened arch shape.

Figure 5:
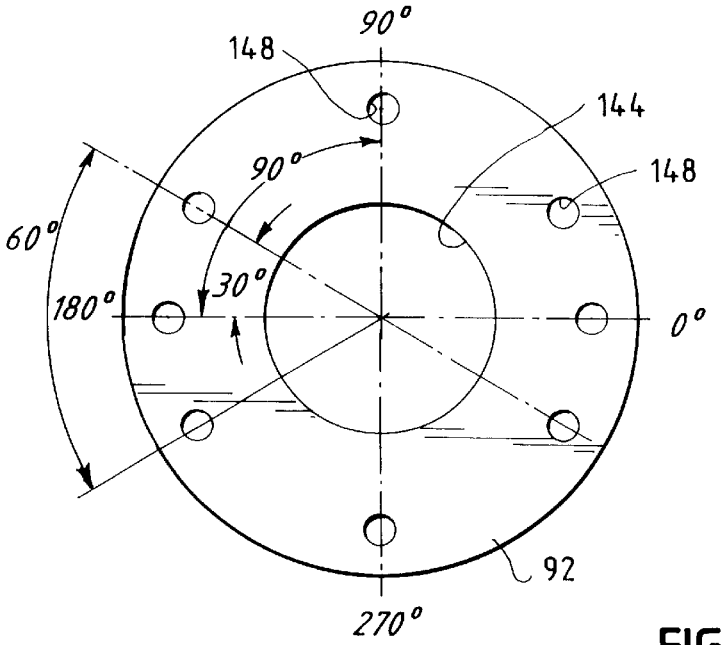
FIG. 5 is a plan view of an adaptor plate shown in FIG. 4.

FIG. 5 illustrates the adapter plate 92. The adapter plate 92 includes a central hole 144 for passing the wires 82, and a plurality of fastener holes 148 for receiving fasteners to clamp the adapter plate to the remaining components. Illustrated are eight bolt holes 148. The holes 148 are arranged at angular positions which are most compatible with the currently available commercial fans. In that regard, holes are located at 0 degrees, 30 degrees, 90 degrees, 150 degrees, 180 degrees, 210 degrees, 270 degrees, and 330 degrees.

Figure 6:
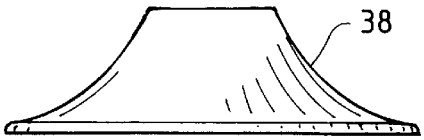
FIG. 6 is a elevational view of a weather shroud of the fan assembly shown in FIG. 1.
Figure 7:
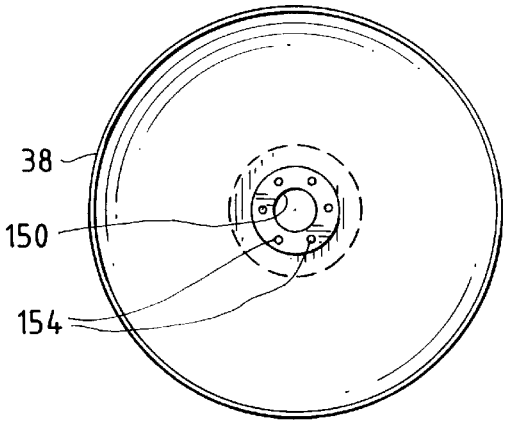
FIG. 7 is a bottom view of the weather shroud shown in FIG. 6.

FIGS. 6 and 7 illustrate the weather shield 38, including a central hole 150 for pass-through of the wires 82, and a plurality of fastener holes 154 which correspond in location to at least some of the fastener holes 148 of the adapter plate 92, preferably corresponding to at least three or four evenly spaced holes. The bolt hole pattern of the flange 98 of the retaining bracket 96 is also correspondingly fashioned.

Figure 8:
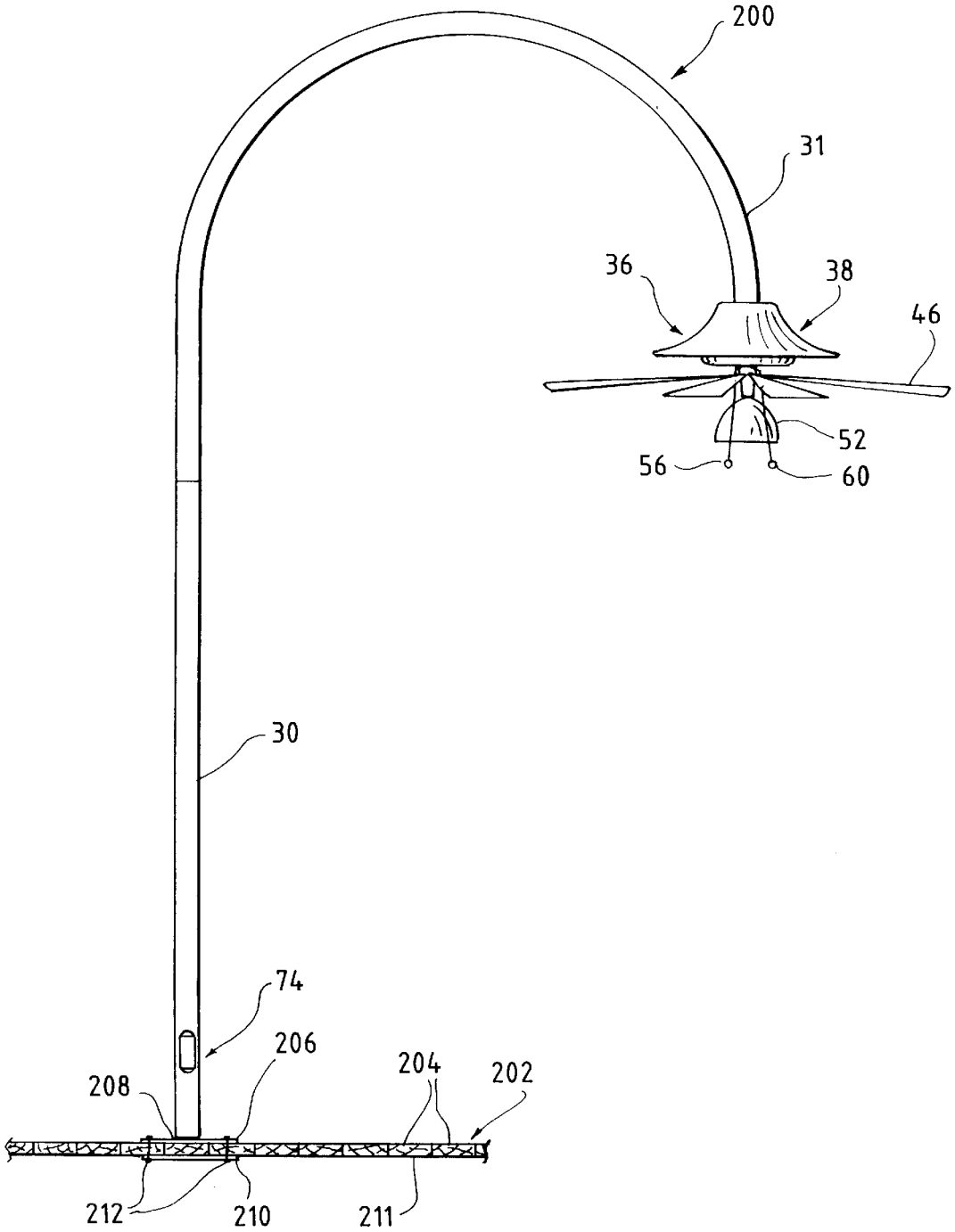
FIG. 8 is an elevational view of a second embodiment fan assembly according to the present invention.

FIG. 8 illustrates a second embodiment fan assembly 200 which is substantially identical to the previous embodiment assembly 21 except for the base mounting details, and the arch-shaped arm 31 of FIG. 1 is employed. The assembly 200 is shown mounted on an outdoor wooden deck 202. In the assembly 200, the base cover is not shown for simplicity, or not used, as desired. The rain tight service cover 74 is typically a service hand hole two inches by four inches with a gasket for making the cover 74 rain tight.

In the embodiment of FIG. 8 a base plate 206 is welded at a bottom 208 of the post 30. An underlying clamp plate 210 can be arranged beneath external structure, such as flooring 211 of the deck 202. A plurality of fasteners 212 can be positioned to pass through corresponding fastener holes arranged in both the base plate 206 and the clamping plate 210. When the fasteners are tightened by use of nuts or by use of bolt head and nut combinations, the base plate 206 is drawn tight to the clamping plate 210, and the post is held upright on the deck 202.

Figure 9:
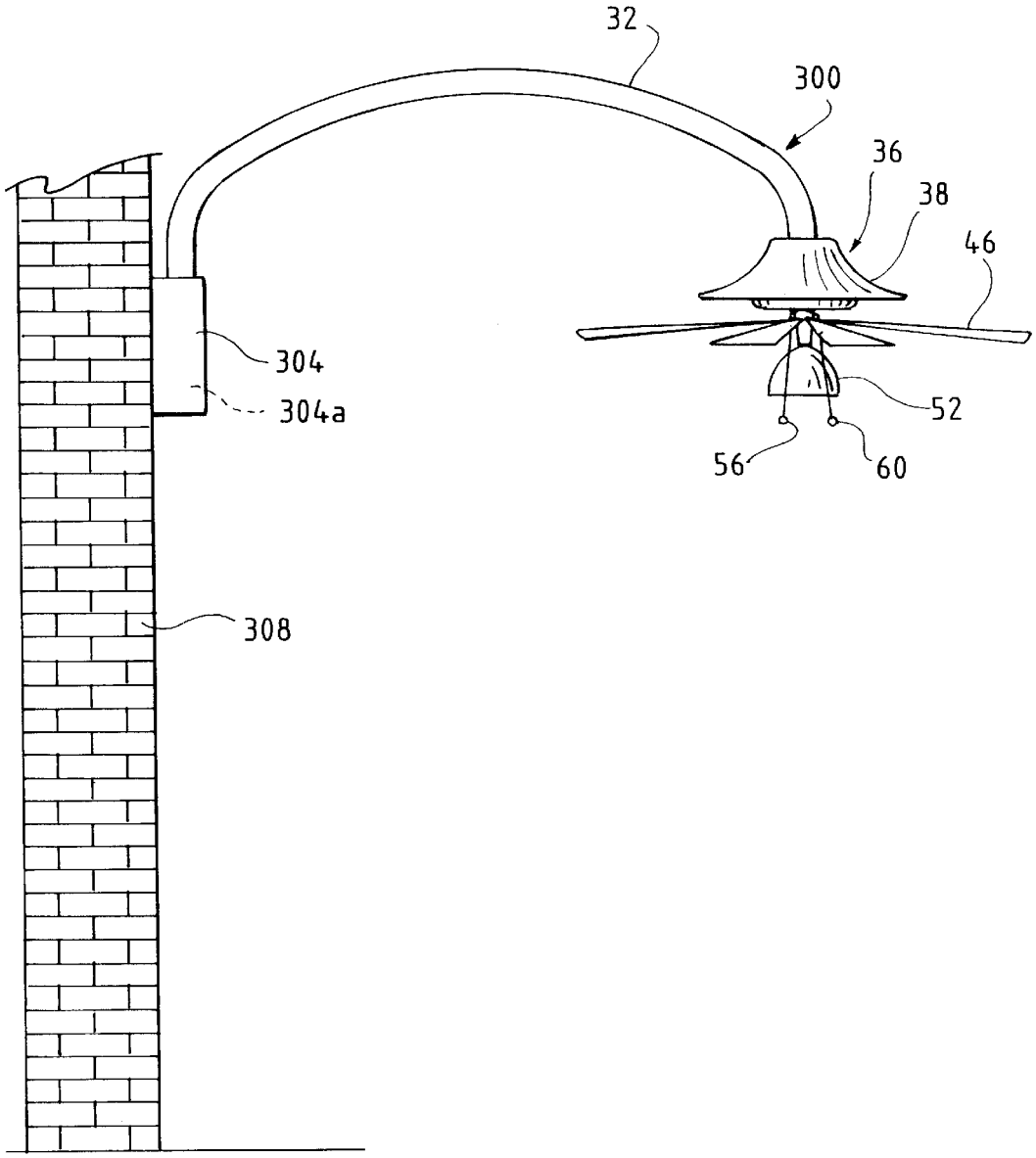
FIG. 9 is an elevational view of a third embodiment fan assembly according to the present invention.

FIG. 9 illustrates a third embodiment of the fan assembly 300. In the fan assembly 300, the post 30 is substantially replaced with a wall mounting fixture 304 which can be fixedly secured to a vertical external structure, such as a wall 308. The mounting structure 304 can be placed over a recessed electrical box (not shown) or can have an enclosed volume 304*a* that functions as a electrical box. Electric power can be fed into the volume 304*a* either from within the wall or externally to the wall. Sufficient wall anchors, studs, bolts, etc. can be used to fixedly attach an appropriate mounting bracket (not shown) of the fixture 304 to the wall 308.

Figure 10:
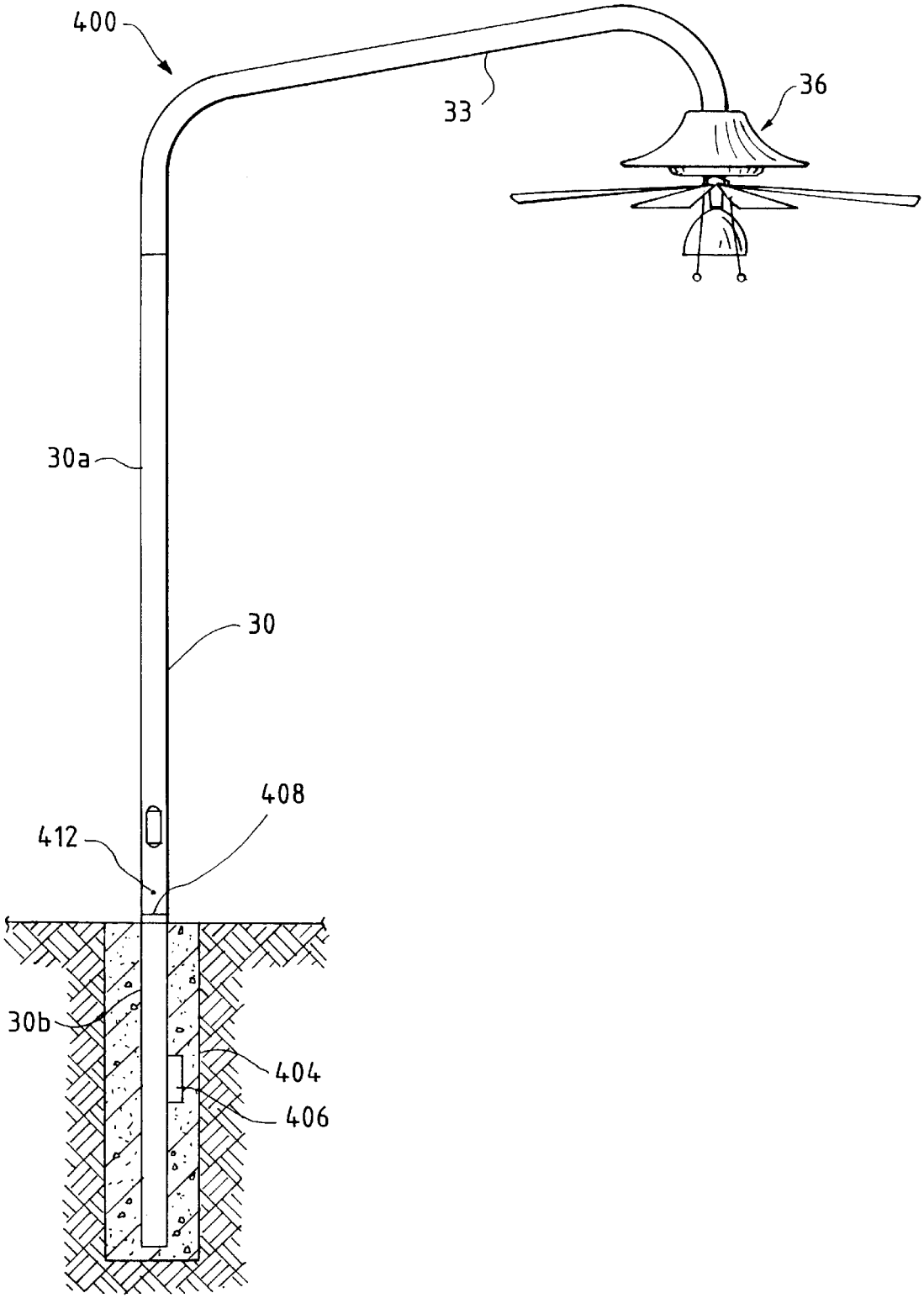
FIG. 10 is an elevational view of a fourth embodiment fan assembly of the present invention.

FIG. 10 illustrates a fourth embodiment fan assembly 400 similar to the first embodiment assembly 21 except that the post 30 extends downwardly into a cylindrical concrete foundation or footing 404. Also, a modified shape arm 33 is used. The post 30 can be seamed above grade at a point 408 to create an above grade post 30*a* and a below grade post 30*b*, so that the above grade post 30 can be removed as desired. The above grade post 30*a* can have a swaged end which can be telescopically inserted approximately six inches into the below grade post 30*b*. A retaining screw 412 can penetrate through the below grade post 30*b* and the above grade post 30*a* to connect the two pieces. A tab 416 is welded to the below grade post 30*b* before the concrete footing 404 is poured to rotationally fix the post 30 with respect to the footing 404.

Figure 11:
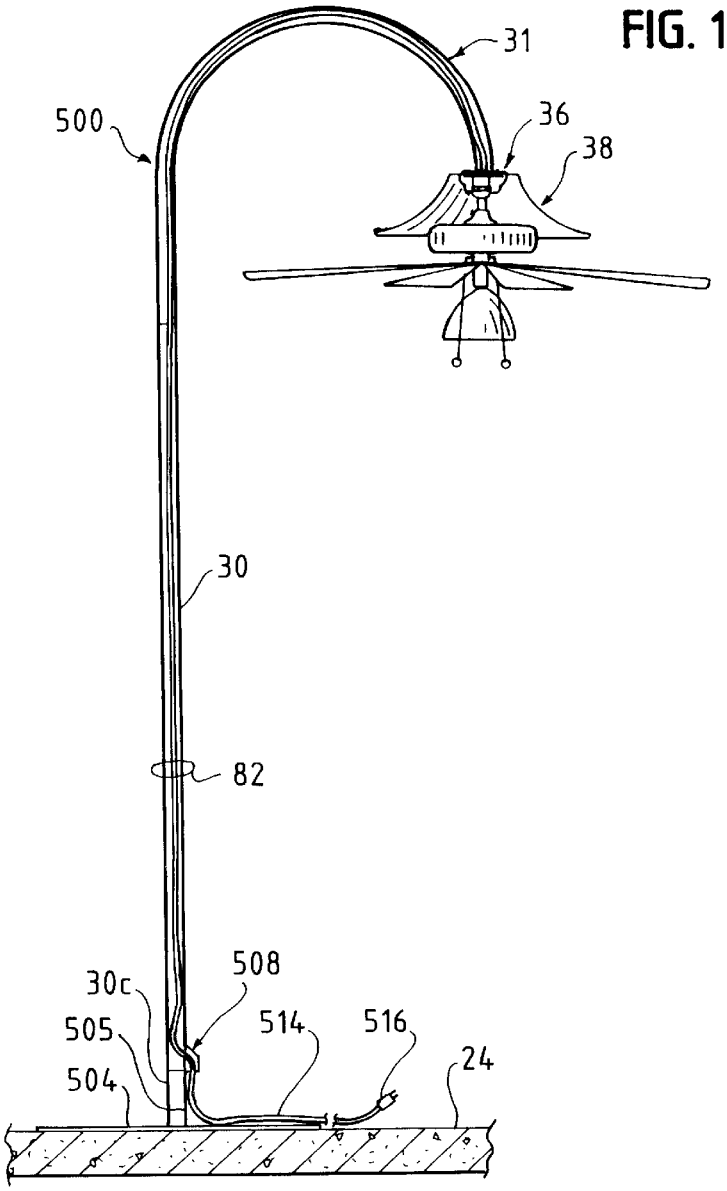
FIG. 11 is sectional view of a fifth embodiment fan assembly of the present invention.

FIG. 11 illustrates a fifth embodiment fan assembly 500 wherein a post stub 30*c* is welded to a large portable base 504 which sets flushly on a support surface 24 such as a concrete slab, without being fixed thereto, i.e., being simply supported. The post stub 30*c* includes a swaged, reduced diameter region. The post 20, telescopically fits down over the reduced diameter region and is secured by a fastener 505 penetrating through the post 30 and stub 30*c*. In the embodiment, the base 504 is a flat plate. The flat plate could be a circular steel plate 32 inches in diameter and 0.375 inches thick. The wires 82 from the subassembly 36 extend through the arm 31, downwardly through the post 30, and exit the post 30 at a weather tight fitting 508 as an appliance cord 514 having a standard wall outlet plug 516. The alternate fan assembly 500 can be plugged into a wall outlet in conventional fashion.

Figure 12:
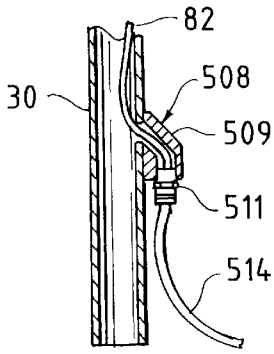
FIG. 12 is a fragmentary, enlarged sectional view of a portion of the fan assembly shown in FIG. 11.

FIG. 12 illustrates the detail of the wire exit from the post 30 at the fitting 508. The weather tight fitting 508 comprises a housing 509 welded to the post 30, and a weather proof grommet 511 threaded into the housing sealing the cord 514 to the housing 509.

Figure 13:
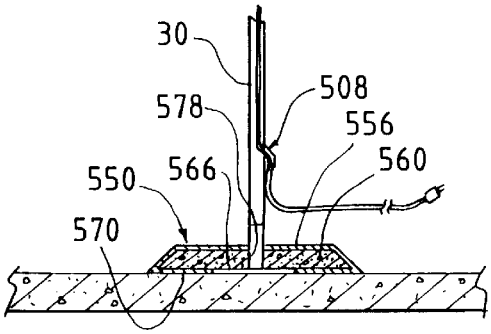
FIG. 13 is a fragmentary sectional view of an alternate base which would be useful in the embodiment of FIG. 11.

FIG. 13 illustrates an alternate base 550 which could be used in lieu of the base plate 514 shown in FIG. 11. The base 550 comprises an outer case 556 composed of plastic or metal or other suitable material. A concrete core 560 fills the case 556. A relatively small anchor plate 566 can be welded to the post 30 and can either be within the case 556 or can form a central portion of a bottom wall 570 of the case 556. The anchor plate 556 prevents the post 30 from being vertically pulled out of the case 556. The case 556 can have the concrete core 560 pre-hardened in place with a pre-formed central hole 578 for receiving the post 30. The concrete filled base 556, as a separate component, can then be placed onto the post 30, the base constituting a removable part. The concrete filled case 556, by nature of its own weight, holds down the anchor plate 556, to retain the post 30 upright. In this manner, the post and base are more easily disassembled for moving and storing the fan assembly. The fan assembly can be sold as separate, easily packaged pieces, with the user providing the concrete to fill the case 556. A heavy concrete part is thus not needed to be shipped by the manufacturer and handled by the retailer.

Figure 14:
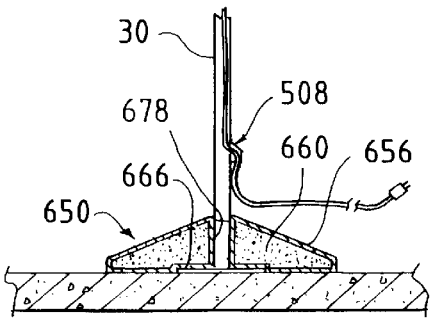
FIG. 14 is a fragmentary sectional view of a second alternate base which wold be useful in the embodiment of FIG. 11.

FIG. 14 illustrates a second embodiment base 650 for use with the portable fan as shown, for example in FIG. 11. The second alternate base 650 includes a case 656 that has a taller central dimension for an increased volume, and is intended to be filled with ballast material 660, such as sand or water, to provide the anchor plate-retaining weight to function as described with regard to FIG. 13, to hold down an anchor plate 666, but with sand or water in lieu of concrete. The remaining description of FIG. 13 is equally applicable to the embodiment of FIG. 14. However, because the ballast material 660 is fluid, the case 650 must have a lined central hole 678 for insertion of the pole during assembly.

Figure 15:
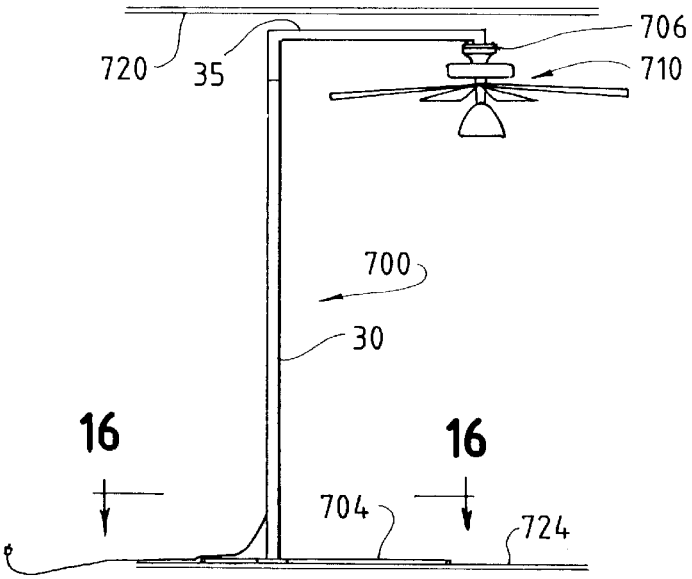
FIG. 15 is an elevational view of an alternate embodiment, portable fan assembly, useful both indoors and outdoors.

FIG. 15 illustrates a further embodiment of a portable fan assembly 700. A motorized fan 710 having a vertical axis of rotation is supported from a portable stand which includes the vertical post 30, a straight cantilever arm 35 and a base 704. The post 30 and the arm 35 can be hollow and telescopically interconnected as described in previous embodiments. The fan adapter plate 92 supports the motorized fan 710 which, as stated before, is a commercially available overhead fan. FIG. 15 illustrates the fan being located in a weather protected area having a ceiling 720, and a floor 724. Given the presence of the ceiling, the motorized fan 710 need not be protected from rain, and as such, the weather shield shown in previous embodiments is optional.

Figure 16:
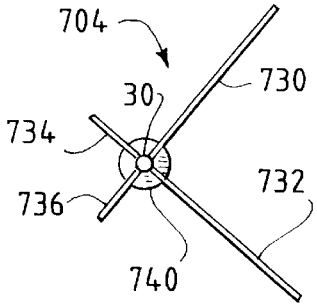
FIG. 16 is a sectional view taken generally along line 16—16 of FIG. 15.

The base 704 of the fan 700 is especially designed to be lightweight yet provide effective support to prevent overturning of the fan 700. As shown in FIG. 16, the base 704 includes four leg portions, two long leg portions 730, 732, and two short leg portions 734, 736. The long leg portions 730, 732 extend in a direction toward the fan 710 to balance the overturning moment created by the overhanging weight of the fan. The short leg portions 734, 736 extend in an opposite direction. A circular tie plate 740 is used to rigidify the relative positions of the four leg portions 730, 732, 734, 736 by being connected to the leg portions at base ends thereof, such as by welding. The leg portions can be formed of tubular elements each having a square, round or other shape cross-section. The use of elongated members as the base 704 allows for the fan to be more easily arranged in and around furniture within an occupied space. Additionally, with the effective use of fasteners, the base 704, when unassembled, can be contained within a smaller package for effective shipping and retailing.

Figure 17:
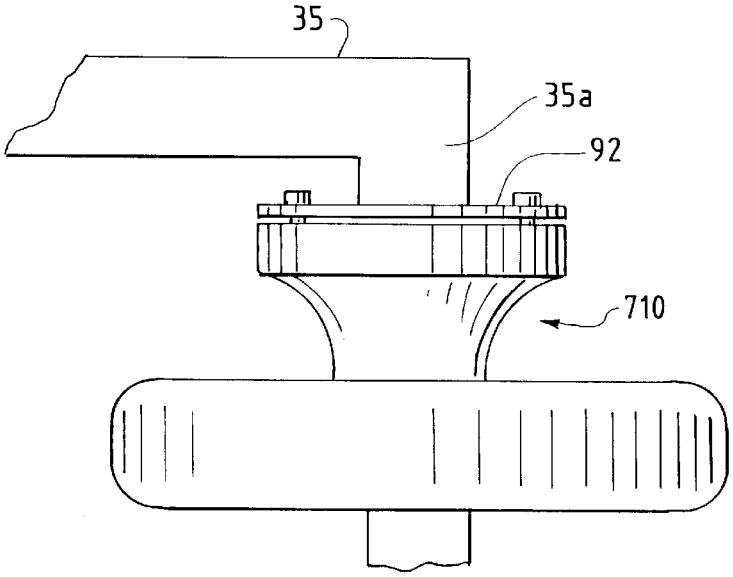
FIG. 17 is a fragmentary, enlarged elevational view of a portion of the embodiment shown in FIG. 15.

FIG. 17 illustrates the fan 710 supported from the cantilever arm 35 via the adapter plate 92 (shown in FIG. 5). As with the previous embodiments, electrical conductors are threaded through the hollow arm 35, and then through the column 30. The adapter plate 92 is welded to a downwardly directed portion 35*a* of the arm 35.

In the embodiments described above, various shapes for the arms 31, 32, 33, 35 are employed. The shapes can be selected to optimize strength for long horizontal reaches, or to optimize overhead clearance for compact designs. Other shapes are possible and are encompassed by the invention. Also, the support structures, including the post 30 and the arms 31, 32, 33, 35, are preferably hollow or tubular elements composed of steel, plastic or other suitable material. The hollow elements can have various cross-sectional shapes such as circular, square, rectangular, or other shapes.

The use of any of the above described fans outdoors can be effective above barbeque cooking areas to help dissipate smoke and fumes from the cooking areas. In this regard, the fan is effectively set to draw air upwardly.

The present inventor has discovered another advantageous application of the above described fan assemblies, particularly in an outdoor environment. When the fans are used overhead, the number of mosquitoes in the area beneath the fan is diminished. This is particularly true when the fan is set to deliver air downwardly. The decrease in mosquitoes may be due to the disturbance in the air around the fan, the disturbance acting to repel mosquitoes.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A fan assembly, comprising:

a support having a surface maintained stationary by external structure;

an arm having a base end connected to said support and extending from said base end horizontally to a distal end;

a motorized fan vertically supported from said distal end and having a vertical rotary axis; and wherein said fan comprises an electric motor, a plurality of fan blades, and a fan mounting bracket supporting said electric motor and said fan blades; and said arm includes a downwardly turned end having an adapter plate thereon, wherein said adapter plate is fastened to said mounting bracket.

2. The fan assembly according to claim 1, comprising a weather shield carried by said arm and adapted to overlie and protect a motor of said motorized fan.

3. The fan assembly according to claim 1, wherein said support comprises a vertically oriented column which is fixed at a base end thereof to external structure.

4. The fan assembly according to claim 1, wherein said support comprises a column and a base, wherein said column is rigidly connected to said base, said base having sufficient weight for said column to be self-standing on the external structure.

5. The fan assembly according to claim 1, wherein said support comprises an attachment plate which is attached to a vertical external structure.

6. The fan assembly according to claim 1, wherein said support comprises a column, and said arm includes a vertical base end portion which is inserted into a top open end of said column.

7. The fan assembly according to claim 1 further comprising a light fixture mounted below said fan and supported therefrom.

8. The fan assembly according to claim 1, wherein said support comprises:

a column arranged substantially vertically;

a base plate, said column connected to said base plate;

a clamping plate, said base plate and said clamping plate having corresponding fastener holes therethrough; and a plurality of fasteners inserted in corresponding apertures in said base plate and said clamping plate to draw said base plate and said clamping plate together to effectively attach said column to an external structure.

9. The fan assembly according to claim 8, wherein said base plate and clamping plate are configured to clamp to external structure in the form of slats of a wooden deck.

10. A fan assembly, comprising:

a support having a surface maintained stationary by external structure;

an arm having a base end connected to said support and extending from said base end horizontally to a distal end;

a motorized fan vertically supported from said distal end and having a vertical rotary axis; and wherein said support comprises a column, and said column is fastened to a vertical external structure to be restrained thereby.

11. A fan assembly, comprising:

a support having a surface maintained stationary by external structure;

an arm having a base end connected to said support and extending from said base end generally horizontally to a distal end;

a motorized fan vertically supported from said distal end and having a vertical rotary axis; and wherein said support comprises a base and a vertical column, said vertical column connected to said base, said base simply supported on external structure, said base having a sufficient horizontal dimension to prevent overturning of said column due to the weight of said motorized fan.

12. The assembly of claim 11, wherein said base comprises plural elongated members arranged in a cross-shape.

13. A support assembly for an overhead fan, comprising:

a support having a surface configured to be maintained stationary by an external structure;

an arm having a base end connected to said support and extending from said base end generally horizontally to a distal end;

a fan connection adapter connected to said distal end and having connection means for attaching an overhead fan to said adapter; and wherein said arm includes a downwardly turned end, and said adapter comprises an adapter plate connected to said downwardly turned end, said adapter plate having plural fastener holes corresponding to fastener holes of said overhead fan.

14. The support assembly according to claim 13, comprising a weather shield carried by said arm and adapted to protect a motor of said overhead fan.

15. The support assembly according to claim 13, wherein said support comprises a vertically oriented column which is adapted to be fixed at a base end thereof to external structure.

16. The support assembly according to claim 13, wherein said support comprises a column having a base, said base being weighted to be self-standing on external structure.

17. The support assembly according to claim 13, wherein said support comprises an attachment plate which is adapted to be attached to vertical external, structure.

18. The support assembly according to claim 13, wherein said support comprises a column, and said column is adapted to be fastened laterally to vertical external structure, to be restrained thereby.

19. The support assembly according to claim 13, wherein said support comprises a vertically oriented, hollow column, and said arm includes a vertically oriented base end portion that fits telescopically with said hollow column to be connected thereto.

20. The assembly of claim 13, wherein said support comprises a base and a vertical column, said vertical column connected to said base, said base having a sufficient horizontal dimension to prevent overturning of said column due to the weight of said motorized fan.

21. The assembly of claim 20, wherein said base comprises plural elongated members arranged in a cross-shape.

22. A support assembly for an overhead fan, comprising:

a support having a surface configured to be maintained stationary by an external structure;

an arm having a base end connected to said support and extending from said base end generally horizontally to a distal end;

a fan connection adapter connected to said distal end and having connection means for attaching an overhead fan to said adapter; and wherein said support comprises a vertically oriented column comprising plural pieces which connect together by telescopic connections.

23. A support assembly for an overhead fan, comprising:

a support having a surface configured to be maintained stationary by external structure;

an arm having a base end connected to said support and extending from said base end generally horizontally to a distal end;

a fan connection adapter connected to said distal end and having connection means for attaching an overhead fan to said adapter; and wherein said support comprises:

a column arranged substantially vertically;

a base plate, said column connected to said base plate;

a clamping plate, said base plate and said clamping plate having corresponding fastener holes therethrough; and a plurality of fasteners inserted in corresponding apertures in said base plate and said clamping plate to draw said base plate and said clamping plate together to effectively attach said column to an external structure.

24. An exterior fan system comprising:

an exterior fan having a plurality of blades that extend generally perpendicularly to a rotatable shaft and having an attachment structure;

a support element having a first section that is positionable generally vertical relative to a mounting surface, a second section that is attached to and extends at an angle to the first section and a mounting section that extends from the second section whereupon the attachment structure for the fan is coupled to the mounting section thereby supporting the fan with the shaft generally perpendicular to the mounting surface whereupon the blades rotate generally in a plane parallel to the surface;

a light fixture carried adjacent to the fan whereby the fan is located between a rain deflector and the light fixture along a line of symmetry generally perpendicular to the mounting surface;

independent on/off switches for the fan and the light fixture; and a support member, carried at an end of the first section for movably supporting the fan on the mounting surface.

25. An exterior fan system comprising:

an exterior fan having a plurality of blades that extend generally perpendicularly to a rotatable shaft and having an attachment structure;

a support element having a first section that is positionable generally vertical relative to a mounting surface, a second section that is attached to and extends at an angle to the first section and a mounting section that extends from the second section whereupon the attachment structure for the fan is coupled to the mounting section thereby supporting the fan with the shaft generally perpendicular to the mounting surface whereupon the blades rotate generally in a plane parallel to the surface;

wherein the mounting section includes a mounting plate having perforations configured for a plurality of different attachment structures.

26. A support assembly for an overhead fan, comprising:

a support having a surface configured to be maintained stationary by an external structure;

a curved arm having a base end connected to said support and extending from said base end to a distal end;

a fan connection adapter connected to said distal end and having connection means for attaching an overhead fan to said adapter; and wherein said arm includes a downwardly turned end, and said adapter comprises an adapter plate connected to said downwardly turned end, said adapter plate having plural fastener holes corresponding to fastener holes of a selected overhead fan.

27. The support assembly according to claim 26, wherein the support comprises a column which releasibly engages the arm.

28. The support assembly according to claim 26, wherein the support comprises a column having a base, said base being weighted to be movable and self-standing on the external structure.

29. The support assembly as in claim 28, wherein the support, the arm and the base are releasibly coupled together.

30. The assembly of claim 28, wherein said the base comprises plural elongated members arranged in a cross-shape.

31. The assembly of claim 26, wherein said support comprises a base and a vertical column, said vertical column releasibly connected to said base, said base having a sufficient horizontal dimension to prevent overturning of said column due to the weight of a motorized fan.

32. A portable fan support comprising:

a movable base having a surface supportable on an exterior structure;

a column releasibly coupled to an extension member;

wherein the column is releasibly coupled to the base and extends generally perpendicular to the surface on the base and the extension member has a distal end, displaced from a centerline for the column, which carries a fan mounting plate oriented generally perpendicular to the column wherein the plate is perforated to match a plurality of different fan mounting configurations.

33. A fan support as in claim 32 wherein the extension member and column telescopically engage one another.

34. A fan support as in claim 32 configured such that when a fan is coupled to the fan mounting plate the fan will be disposed between the plate and the base, offset from the centerline of the column.

35. A fan support as in claim 32 wherein the extension member is tubular.

36. A fan support as in claim 32 wherein the extension member is curved.

37. A fan support as in claim 32 wherein the column is slidably coupled to the base.

38. A fan support as in claim 37 which includes a weathershield carried adjacent to the fan mounting plate.

39. An exterior fan system, positionable on a surface, for insect control, comprising:

an exterior fan having a plurality of blades that extend generally perpendicularly to a rotatable shaft and having an attachment structure;

a movable base supportable on a surface;

a support element having a first section that is positionable generally vertical relative to the surface, a second section that extends at an angle to the first section, wherein the base, the first section and the second section releasibly engage one another, and a mounting section that extends from the second section whereupon the attachment structure for the fan is coupled to the mounting section thereby supporting the fan with the shaft generally perpendicular to the surface whereupon the blades rotate generally in a plane parallel to the surface to disturb the ambient air thereby making the air in the vicinity less hospitable to insects wherein the first and second sections are tubular and slidably engage one another and the base.

40. An exterior fan system, positionable on a surface, for insect control, comprising:

an exterior fan having a plurality of blades that extend generally perpendicularly to a rotatable shaft and having an attachment structure;

a movable base supportable on a surface;

a support element having a first section that is positionable generally vertical relative to the surface, a second section that extends at an angle to the first section, wherein the base, the first section and the second section releasibly engage one another, and a mounting section that extends from the second section whereupon the attachment structure for the fan is coupled to the mounting section thereby supporting the fan with the shaft generally perpendicular to the surface whereupon the blades rotate generally in a plane parallel to the surface to disturb the ambient air thereby making the air in the vicinity less hospitable to insects wherein the mounting section is perforated and couplable to a plurality of different fan attachment structure.

* * * * *